United States Patent [19]

Vargo

[11] 4,142,638

[45] Mar. 6, 1979

[54] PREFABRICATED STORAGE SHELVES

[75] Inventor: William R. Vargo, Altanta, Ga.

[73] Assignee: Husky Storage Systems, Inc., Cleveland, Ohio

[21] Appl. No.: 801,592

[22] Filed: May 31, 1977

[51] Int. Cl.[2] ..... A47F 5/10

[52] U.S. Cl. ..... 211/187; 108/110; 248/243

[58] Field of Search ..... 248/235, 243, 244, 245; 211/189, 187, 190, 191, 186, 192; 108/106, 107, 110

[56] References Cited

U.S. PATENT DOCUMENTS

| | | | |
|---|---|---|---|
| 3,070,267 | 12/1962 | Polzin | 248/243 X |
| 3,127,995 | 4/1964 | Mosinski | 211/191 |
| 3,194,407 | 7/1965 | D'Altrui | 211/191 X |
| 3,637,087 | 1/1972 | Denny | 211/192 |
| 3,858,988 | 1/1975 | Cohen | 211/189 X |
| 3,862,691 | 1/1975 | Mori et al. | 211/191 |
| 3,983,823 | 10/1976 | McDonnell | 248/243 X |

*Primary Examiner*—J. Franklin Foss

*Attorney, Agent, or Firm*—Meyer, Tilberry & Body

[57] ABSTRACT

A prefabricated storage shelf which can be easily and quickly assembled, disassembled or modified. The vertical posts have a plurality of equally spaced tabs struck from the walls of the post and which tabs have: a gusset formed at the base thereof for increasing the section modulus of the tab; a shape to aid insertion into the openings of horizontal beams; and, a pimple for retaining the horizontal beams in assembled position. Horizontal beams are provided which can be inverted to mate with different thicknesses of lumber forming the shelf. Brackets are provided for coacting with horizontally extending beams.

4 Claims, 10 Drawing Figures

FIG. 1
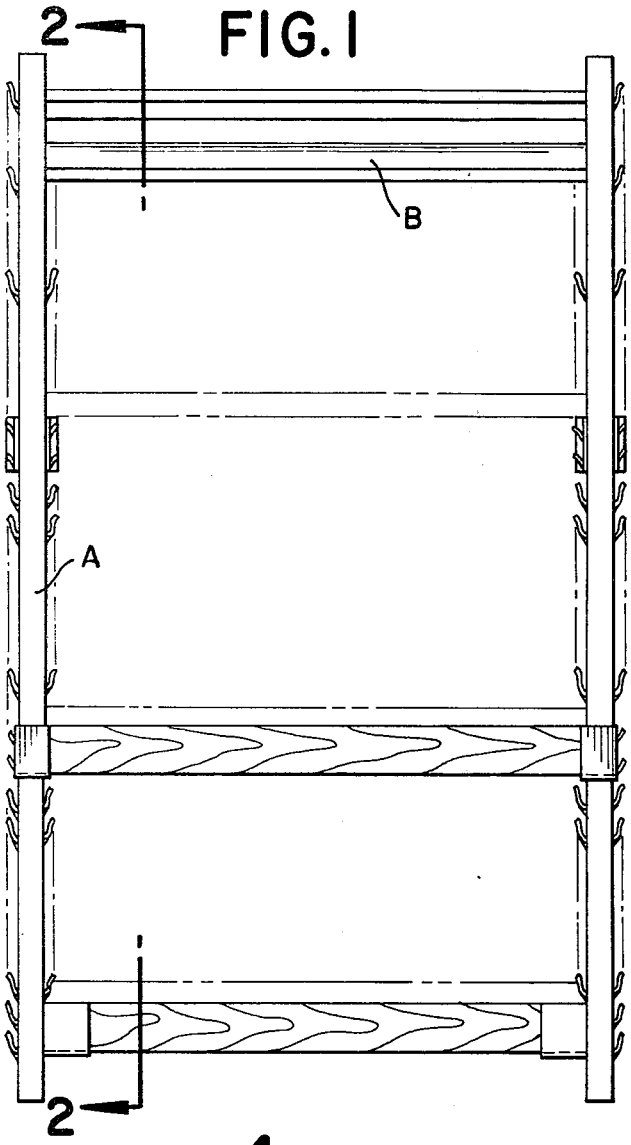
FIG. 2
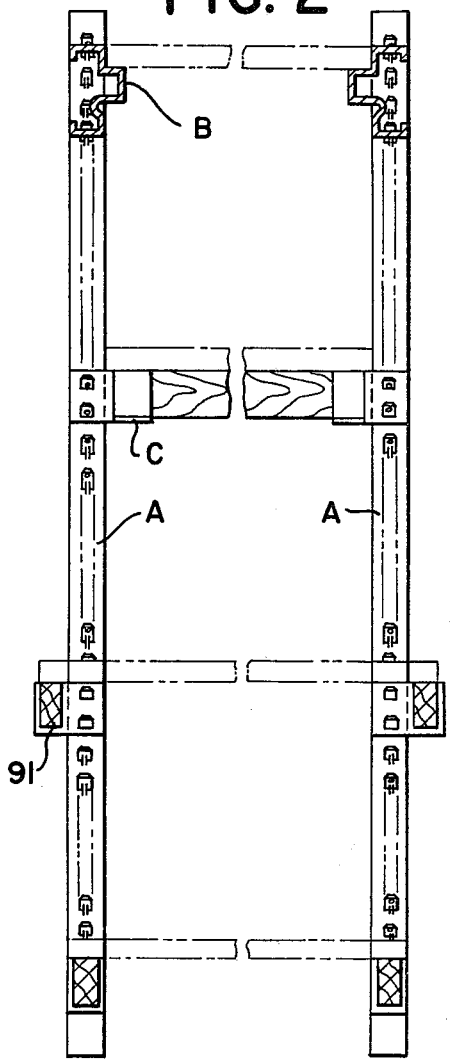
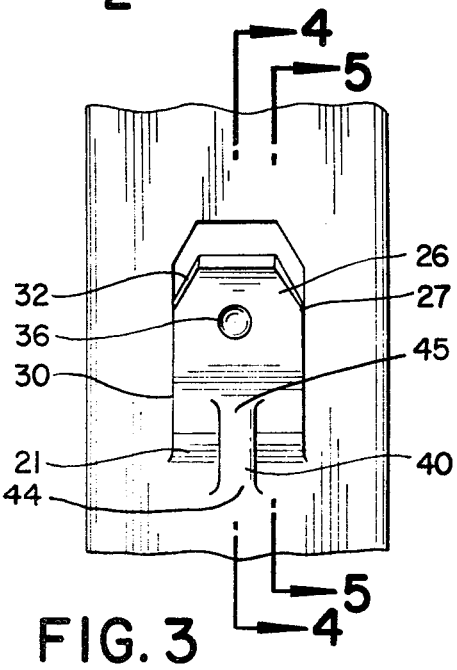
FIG. 3
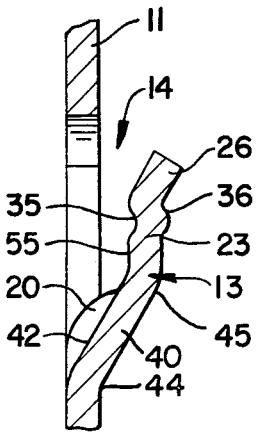
FIG. 4
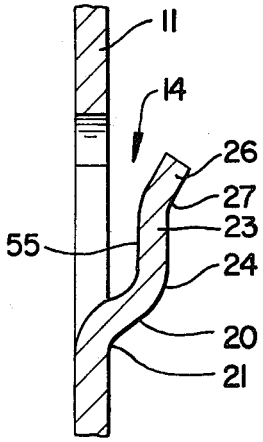
FIG. 5

FIG. 6
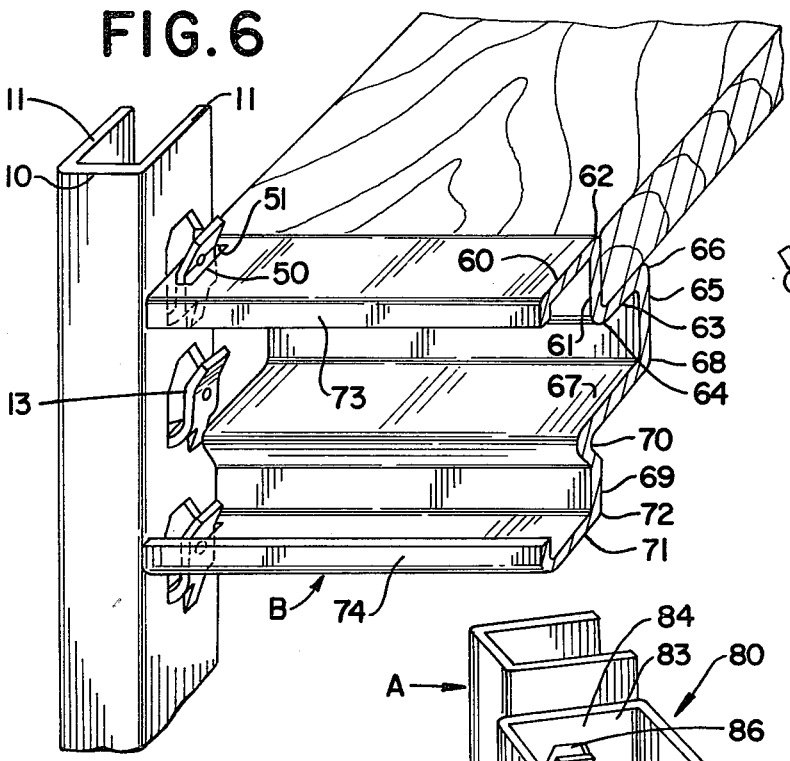
FIG. 7
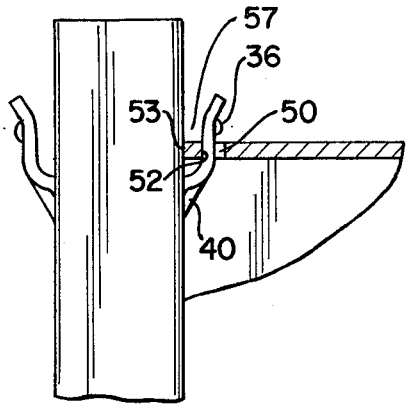
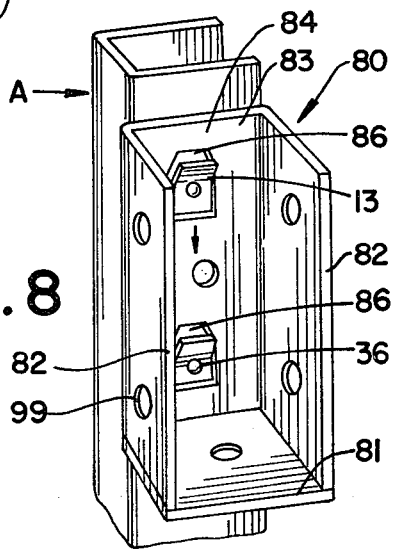
FIG. 8
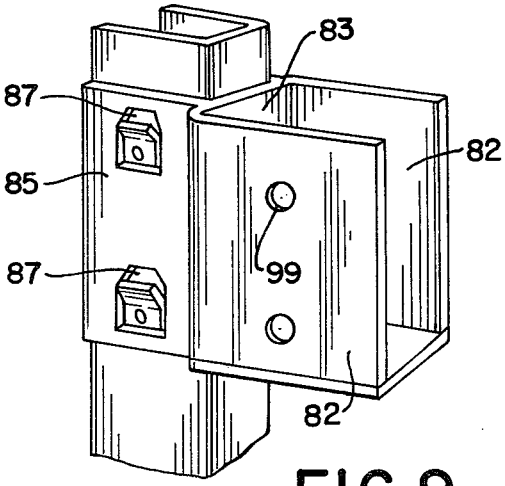
FIG. 9
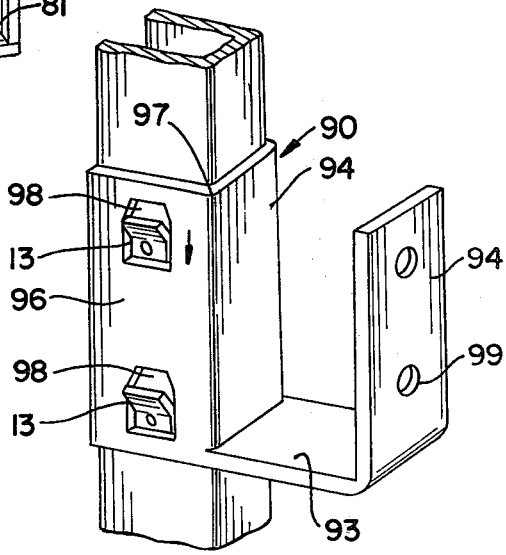
FIG. 10

PREFABRICATED STORAGE SHELVES

This invention pertains to the art of storage shelves and more particularly to storage shelves of the type which can be easily and quickly assembled, disassembled or modified.

Many different forms of knock-down shelving have been proposed. The principal problem with all such shelving is in developing sufficient rigidity and strength in the joints to give the shelving stability and in the large number of various prefabricated elements which must be supplied in order to give the shelf designer the maximum degree of flexibility.

The present invention contemplates a new and improved shelving arrangement which overcomes the difficulties of the prior art and provides a shelving framework which is easily assembled, easily disassembled, is rigid and which can perform the maximum number of different functions in shelving with a minimum number of standardized prefabricated parts.

In accordance with the invention, the shelving is comprised of a plurality of vertical posts having walls of generally uniform thickness, the walls being provided with a plurality of vertically spaced tabs struck from the wall of the post by a stamping operation with the bend where the tab is integral with and curves away from the metal of the post being provided with a bridging gusset to increase the section modulus of the metal at the base of the tab.

Further, in accordance with the invention, the tab curves upwardly and outwardly thence vertically upwardly and then upwardly and outwardly and away from the outer surface of the wall and the upper portion of the parallel part is provided with a pimple whereby to assist in locking horizontal beams mounted on said tabs in position.

Further in accordance with the invention, a horizontal beam is provided having tab receiving openings top and bottom and having upper and lower shelf receiving grooves formed in a side of the beam with the depth of the grooves being different so that by inverting the beam, shelving of different thicknesses may be accommodated.

Still further in accordance with the invention, brackets for receiving horizontal beams are provided comprised of a four-sided box open at the top and front to provide a beam receiving space and means on the back side for coacting with the tabs on the vertically extending posts of the shelving.

Further in accordance with the invention, a bracket is provided for supporting a beam midway of its length comprised of a U-shaped member having a base and a pair of legs and means associated with one of the legs and extending away therefrom for coacting with the mounting tabs on the vertical posts for supporting the bracket in position.

The principal object of the invention is the provision of a new and improved shelving arrangement which is easily assembled, easily disassembled, and easily modified after assembly.

Another object of the invention is the provision of a new and improved vertical post for shelving where the posts are provided with a plurality of tabs for coacting with horizontal beams, the tabs being bent outwardly from the wall of the post and having a gusset bridging the bend where the tab leaves the post for the purpose of increasing the section modulus of the tab at the base.

Another object of the invention is the provision of a new and improved horizontal beam for knock-down shelving which beam is so arranged that by inverting it, it will accept two different thicknesses of shelving.

A further object of the invention is the provision of a new and improved bracket for coacting with a supporting beam which is easily assembled on the supporting posts and which is relatively simple and inexpensive in construction.

The invention may take physical form in certain parts and arrangements of parts, a preferred embodiment of which will be described in detail in this specification and illustrated in the accompanying drawing which form a part hereof and wherein;

FIGS. 1 and 2 are front and side elevational views of a shelving arrangement illustrating a preferred embodiment of the present invention;

FIG. 3 is a fragmentary view of a vertical post of the shelving greatly enlarged showing the tabs for coacting with the horizontal beams;

FIG. 4 is a cross sectional view of FIG. 3 taken approximately in the line 4—4 thereof;

FIG. 5 is a cross sectional view of FIG. 3 taken approximately in the line 5—5 thereof;

FIG. 6 is an enlarged perspective view of a horizontal beam coacting with a vertical post which beam by inverting it can accommodate various thicknesses of shelving;

FIG. 7 is a front elevational view of a post and tab shown in coacting relationship with a beam in cross section;

FIG. 8 is a perspective view of a bracket for receiving an end of a horizontal beam and supporting same relative to the vertical posts of the shelf;

FIG. 9 is a view similar to FIG. 7 showing an alternative embodiment; and, FIG. 10 is a side perspective view of a bracket for supporting a horizontal beam midway of its ends.

Referring now to the drawings, wherein the showings are for the purposes of illustrating a preferred embodiment of the invention only and not for the purpose of limiting same, FIGS. 1 and 2 show a shelving arrangement comprised of a plurality of vertical posts A, a horizontally extending beam B arranged to receive the edge of a wooden shelf and a bracket arrangement C for receiving the end of a horizontal beam.

The vertical posts A may have any desired cross sectional shape but in the preferred embodiment, are generally U-shaped having a base 10 (see FIG. 6) and a pair of parallel side walls 11, the vertical post being formed from a flat sheet or plate of steel either cold-rolled or bent to the desired shape in a brake. It will be appreciated that the posts may also be hot-rolled from a billet although as will appear the formation of tabs on such a hot-rolled post would be difficult.

In the preferred embodiment, the side walls 11 of the post are each provided with a plurality of tabs 13 which extend upwardly and outwardly beyond the outer surfaces of the side walls 11 to form an upwardly opening slot 14 to receive a portion of a supporting beam or bracket when they are assembled therewith, as will appear.

These tabs 13 are each struck from the portion of the steel plate which will form the side wall of the post when the metal plate is ultimately formed into the U-shaped cross section shown. These tabs 13 in the embodiment shown include a first portion 20 integral at its lower edge with the side wall 11 which portion angles upwardly and outwardly from a radiused bend 21 joining the tab 13 with the side wall 11. The upper edge of this portion 20 is integral with a generally vertically extending portion 23, the two portions being joined by a horizontal bend 24 of a reverse curvature to that of the bend 21 joining the lower edge of the first portion 20 to the side wall 11.

The upper edge of the second portion 23 is integral with the lower edge of a third portion 26 which angles upwardly and outwardly from the upper edge, the integral portion being a horizontal bend 27 of a reversed curvature to the curvature of the bend 24 between the first and second portions.

In the preferred embodiment, the edges 30 of the first and second portions are generally straight and parallel while the edges 32 of the third portion 26 converge in an upward direction.

At a point positioned just below the third bend 27, a dimple 35 is formed in the inner surface of the tab which results in a pimple 36 on the opposite surface of the tab extending away from the outer surface or plane of the wall 11 of the post. In some instances, the pimple may face the opposite direction.

The purpose of this pimple 36 is to coact with the walls of an opening in the beams to be supported by the post to prevent accidental removal thereof.

In accordance with the invention, means are provided for increasing the section modulus of that portion of the tab 13 where it joins to the side wall 11. In the preferred embodiment, this means is comprised of one or more vertically extending gussets 40 formed in the lower most bend 21 of the tab 13 by dimpling or indenting the inner surface of the metal as at 42 to a degree such that the outer surface is generally flat and projects out beyond the surface of the bend 21 so as to have its lowermost end 44 below the bend 21 and its upper end 45 generally tangent with the second bend 24. The section modulus of the metal at the bend 21 is substantially increased resulting in an increase in the bending strength of the tabs 13.

The beams B may take a number of different forms but in all of the embodiments they are formed from heavy sheet metal and a horizontal surface adjacent the end is provided with a rectangular opening 50 defined by side walls 51 and an end wall 52 spaced from the end 53 of the beam by an amount just equal to the spacing between the inner surface 55 of the second portion 23 of the tab and the plane of the outer surface of the side wall 11 from which the tab is struck. In this respect, the pimple 36 widens the thickness of the tab to be just less than the width of the opening 50 such that when the beam is installed in position on a post, the portion 57 will be snapped into the upwardly open space 14 defined by the tab.

It will be appreciated that the gusset 40 makes the bottom portion of the tab rather rigid. However, the gusset does not extend generally into the second portion 23 such that the tab will have a slight degree of flexibility to enable the upper portions of the tab to bend away resiliently and enable the portion 57 of the beam to fit into the upwardly opening space 14 defined by the tab 13 and the outer side of wall 11 of the post.

It will be appreciated that the inner surface of the first portion 20 converges in a downward direction toward the outer surface of the side wall 11 and when the portion 57 of the beam between the hole 50 and its end 53 is in the space 14 defined by the tab, it is wedged between the outer surface of the side wall and the inner surface of the first portion resulting in a rigid construction. On the other hand, the gusset 40 gives rigidity to the first portion 20 preventing it from bending away from the outer surface of the plate.

Without the gusset 40, the section modulus of the lower portion of the tab and particularly, the first bend, would be defined by the exact cross sectional area of the lower end of the tab 13, namely the plate thickness and the width of the tab. However, by providing the gusset 40, the section modulus is substantially increased without increasing the cross sectional area of the tab 13 itself. A very substantial increase in rigidity and overall strength of the assembled shelves result.

As heretofore pointed out, one of the problems with prefabricated shelving is the number of the various pieces which must be supplied or kept in stock in order to satisfy the maximum variation in the needs of the customer. In accordance with the invention, the horizontal beam B supports flat wooden shelving and by being simply inverted will enable shelving of, for example, one and one half inch thickness or one inch thickness to be selectively supported while still having the upper edge of the shelf flush with the upper surface of the supporting beam.

Referring now to FIG. 6, such a beam B is shown in perspective cross section and is comprised of a beam formed or rolled from heavy sheet metal into a shape having a first upper horizontal wall 60; a second wall 61 extending vertically downwardly from the front edge of the first wall and joined thereto by an integral right angle bend 62; a third horizontal wall 63 extending forwardly from the lower edge of the second wall 61 and joined thereto by a right angled bend 64; a fourth wall 65 extending downwardly from the front edge of the third wall 63 and joined thereto by a right angled bend 66; a fifth horizontal wall 67 extending backwardly from the lower edge of the fourth wall and joined thereto by a right angled bend 68; a sixth vertically extending wall 69 extending downwardly from the back end of the fifth horizontal wall 67 and joined thereto by a Z bend 70; and a seventh horizontal wall 71 extending backwardly from the lower edge of the sixth wall 69 and joined thereto by an integral bend 72.

In the preferred embodiment, the inner ends of the first and seventh walls are provided with downwardly and upwardly extending flanges 73, 74 which while not forming any part of this portion of this invention do provide a finished look for the beam and add a degree of horizontal strength thereto and also provides a continuous label retaining slot.

The first and seventh horizontal walls 60 and 71 at each end of the beam B are provided with rectangular openings 50 of a size, shape and position as described above so that the beam B can be mounted on a post A as desired by positioning an end of the beam against the outer surface of the post and then lowering it so that the tabs 13 enter the openings 50 of both the upper and lower walls 60 and 71 resulting in the end of the beam being held firmly in contact with the outer surface of the side wall 11 giving to the shelving substantial rigidity.

It is to be noted that preferably the upper and lower walls 60, 71 are spaced apart a distance equal to the spacing of the tabs or multiples of this spacing. Thus, if the tabs 13 are spaced apart vertically two inches, the vertical dimension of the beam is preferably four inches. Moreover, as shown in FIGS. 2 and 6, the opposite ends of the fifth and sixth walls of the beam B are configurated to lie clear of the tab or tabs 13 located between the two of such tabs respectively engaged by the first and seventh walls of the beam when supported on the vertical posts A in either of its invertible positions thereon.

The walls 61 and 63 define an upwardly and inwardly opening recess or ledge for receiving and supporting a shelf preferably with the upper surface of the shelf either flush with the upper wall 60 or slightly thereabove.

In the same manner, if the beam is inverted, the walls 67, 69 will define an inwardly and upwardly opening recess or ledge which can likewise receive and support the edge of a shelf or the like. As a principal part of the invention, it is preferred that the vertical depth of the recesses be different such that the beam B can accommodate different thickness shelves by simply inverting the same end for end. Thus, in the preferred embodiment the vertical height of the recess defined by the walls 61, 63 is ¾ of an inch, while the vertical height of the recess defined by the walls 67, 69 is one inch, this being adequate to accept ¾ inch or one inch plywood as the designer or assembler of the shelves desires. In the alternative, the recesses defined by these walls may be arranged to accept one inch and one and one half inch lumber or may be designed to accept nominal "two-by-fours" or "two-by-fours" cut into "two-by-two's".

Referring now to FIG. 8, a bracket 80 is shown for the purpose of receiving and supporting the ends of horizontally extending beams and preferably beams formed from "two-by-four" lumber. Thus, the bracket shown in FIG. 8 is comprised of a bottom plate 81 and a pair of parallel extending side plates 82 with their lower edges abutting against the side edges of the bottom plate, and a back plate 83 having its vertical edges preferably integral with or welded to the vertical edges of the side plate and its lower edge either integral with or welded to the back edge of the bottom plate 81. These bottom, side, and back plates 81, 82, 83 define an upwardly and outwardly opening recess 84 of a dimension preferably equal to that of the cross section of standard two-by-four lumber.

Means are provided for mounting bracket 80 on the vertical post. In the embodiment shown in FIG. 8, the back plate 83 is provided with a pair of openings 86 spaced vertically apart the same distance as the tabs 13 on the vertical post A and of a width to just fit over the tab. These openings 86 have a vertical height somewhat less than the vertical height of the tabs 13 but at least equal to the distance from the upper surface of the lower bend 21 and the lower edge of the gusset 40 so that the back side of the back plate 83 can fit flush and snugly against the outer wall 11 of the vertical post A. In this respect, it is to be noted that the thickness of the back plate 83 must be less than the spacing between the pimple 36 facing inwardly in this case; and the plane of the outer wall 11 of the post A but not substantially less than that. Preferably the thickness of the plate 83 in FIG. 8 and the width of the portion 57 between the back edge 52 of the opening 50 and the end 53 of the beam in FIG. 7 is identical.

FIG. 9 shows an alternative embodiment for mounting the bracket on the post. In this embodiment, a mounting plate 85 extends backwardly from the back plate 83 and in a plane parallel to the side plates 82. This mounting plate 85 has a pair of openings 87 therein generally identical to the openings in the back plate of the embodiment shown in FIG. 8 and this mounting plate has a similar thickness.

Referring now to FIG. 10, a bracket 90 is shown for supporting a beam 91 intermediate its ends and in this embodiment, the bracket is comprised of a base 93 and a pair of parallel spaced upwardly extending side walls 94 integral with or welded to the side edges of the base 93 at their lower end. These side plates 94 are spaced a distance and have a vertical height such as to define an opening equal to the cross sectional area of a standard lumber, e.g. two-by-four lumber.

Means for mounting this bracket are in the form of a mounting plate 96 having one edge integral with one edge of one of the side plates 94 and joined therewith at a right angled bend 97. This mounting plate has a pair of openings 98 therein for receiving the mounting tabs 13, the openings being generally of the same dimensions as those shown in FIG. 8.

It is to be noted that in FIGS. 8–10, the side plate and/or bottom plate are provided with screw receiving openings 99 so that the beams in the space defined by the side walls can be rigidly fastened to the bracket.

It is believed that the assembly of the shelving is obvious to one skilled in the art. It will not be further detailed herein. The gusset construction at the base of the tabs contributes substantially to the strength of the tab under the forces imposed upon the shelving and in particular those tending to make it move sideways. Furthermore, the shape of the tab enables the various horizontal beams and/or brackets to be readily quickly assembled therewith and these members quickly snug up to a very tight fit.

Having thus described the invention, I claim:

1. An invertible horizontal beam for selectively supporting shelves of differing thicknesses with the surface of the shelf generally flush with the upper surface of the beam, said beam having walls of generally uniform thickness and in cross section including: a first horizontal wall extending from back to front; a second vertical wall extending downwardly from the front edge of said first wall, a third horizontal wall extending forwardly from the lower edge of said second wall and forming a shelf supporting surface; a fourth wall extending vertically downwardly from the front edge of said third wall, a fifth wall extending horizontally back from the lower edge of said fourth wall, a sixth wall extending vertically downwardly from the back edge of said fifth wall; and, a seventh wall extending horizontally backwardly from the lower edge of said sixth wall, the vertical dimensions of said second and sixth wall being different with the vertical height of one being equal to a standard lumber thickness and the vertical height of the other being equal to another standard lumber thickness, both longitudinal ends of both said first and seventh walls having means formed therein adapted to coact with means formed in the walls of vertical posts of a storage rack for supporting said beam, said beam being substantially open-sided at the back thereof.

2. The invertible horizontal beam of claim 1 wherein said means to coact with said posts includes transverse slots in said first and seventh walls of said beam adjacent both ends thereof for receiving upwardly extending tabs on said posts.

3. The invertible horizontal beam of claim 2 wherein the said tabs are vertically spaced uniformly apart on said posts a distance approximately one-half the spacing of said first and seventh horizontal walls of said beam, and wherein the opposite ends of said fifth and sixth walls are configurated to lie clear of the one of said tabs between the two said tabs respectively engaged by said first and seventh walls of said beam when coactively supported on said posts in either of its invertible positions thereon.

4. In a storage rack, a vertical metal post having walls of generally uniform thickness, a plurality of tabs struck from said walls at equally spaced vertical distances and each including a first portion integral with the respective wall at its lower edge and diverging from a first horizontal bend outwardly and upwardly; a second portion integral with the upper edge of said first portion and extending generally vertically upwardly from a second reverse horizontal bend in spaced relationship to the outer surface of said wall; and a third portion integral at its lower edge with the upper edge of the second portion and angling upwardly and outwardly from a third bend, the improvement which comprises; a vertically extending gusset formed in said first horizontal bend by stamping and extending above and below same for increasing the section modulus of the metal at said first horizontal bend, said tab including a pimple formed by stamping on the said second portion adjacent the upper edge thereof and extending away from the post side wall for coacting with the wall of an opening of a horizontal beam adapted to be supported on said post by said tab extending into said opening, the total thickness dimension of said tab at said pimple being just less than the width of said opening to thereby restrain said beam against dislodgement from said post.

* * * * *